US007891526B2

(12) United States Patent
Schliemann

(10) Patent No.: US 7,891,526 B2
(45) Date of Patent: Feb. 22, 2011

(54) DOSING DEVICE

(76) Inventor: Eric Schliemann, 18 Im Wornbühl, 78256 Steisslingen (DE)

( * ) Notice: Subject to any disclaimer, the term of this patent is extended or adjusted under 35 U.S.C. 154(b) by 920 days.

(21) Appl. No.: 10/539,922

(22) PCT Filed: Dec. 17, 2003

(86) PCT No.: PCT/EP03/14401

§ 371 (c)(1),
(2), (4) Date: Aug. 9, 2007

(87) PCT Pub. No.: WO2004/054720

PCT Pub. Date: Jul. 1, 2004

(65) Prior Publication Data

US 2008/0041894 A1 Feb. 21, 2008

(30) Foreign Application Priority Data

Dec. 17, 2002 (DE) ..... 102 59 275

(51) Int. Cl.
*B05B 11/02* (2006.01)

(52) U.S. Cl. ..... 222/321.7; 222/321.8; 222/321.9; 222/383.3; 222/631

(58) Field of Classification Search ..... 222/23, 222/321.1, 321.3, 321.7, 321.9, 380, 383.1, 222/383.3, 309
See application file for complete search history.

(56) References Cited

U.S. PATENT DOCUMENTS

| | | | | |
|---|---|---|---|---|
| 3,116,856 | A * | 1/1964 | Prussin et al. | 222/402.24 |
| 3,429,483 | A * | 2/1969 | Micallef | 222/153.11 |
| 3,907,174 | A * | 9/1975 | Steiman | 222/153.13 |
| 4,838,460 | A * | 6/1989 | Moore et al. | 222/153.13 |
| 4,871,092 | A * | 10/1989 | Maerte | 222/153.13 |
| 5,085,347 | A * | 2/1992 | Hayes et al. | 222/153.02 |
| 5,203,841 | A * | 4/1993 | Kitabayashi | 222/402.11 |
| 5,615,806 | A * | 4/1997 | Grothoff | 222/153.13 |
| 5,775,547 | A * | 7/1998 | Foster et al. | 222/321.3 |
| 6,105,826 | A * | 8/2000 | Oursin et al. | 222/153.06 |
| 6,164,498 | A * | 12/2000 | Faughey et al. | 222/309 |
| 6,443,331 | B1 * | 9/2002 | DeJonge | 222/153.13 |
| 6,644,516 | B1 * | 11/2003 | Foster et al. | 222/190 |
| 6,672,486 | B2 * | 1/2004 | Santagiuliana | 222/207 |

* cited by examiner

*Primary Examiner*—Kenneth Bomberg
*Assistant Examiner*—Donnell Long
(74) *Attorney, Agent, or Firm*—Bachman & LaPointe, P.C.

(57) ABSTRACT

In a dosing device for drawing in and dispensing a free-flowing medium from a container having an inlet (60) and a discharge opening (62.1 to 62.4), the inlet (60) and the discharge opening (62) are disposed separate from each other, a dosing and displacement chamber (61) being provided between them and the inlet (60) and/or discharge opening (62.1 to 62.4) being closable.

10 Claims, 6 Drawing Sheets

DOSING DEVICE

The present invention relates to a dosing device for drawing in and dispensing a free-flowing medium from a container having an inlet and a discharge opening.

PRIOR ART

Dosing devices of this type are known and are in common use in a variety of shapes and constructions. Dosing devices can be found, for example, in cream containers in the pharmaceutical sector or in sauce containers in the food sector, or the like. The liquid or the like present in the container or the like is dispensed by simple pressing-down of a pump. According to the quantity desired, the pump is pressed down more or less strongly. A precise dosing is not possible, however.

If a liquid is intended to be dispensed only in drops, for example, it is often necessary to resort to a traditional pipette. The drawback is, however, that only small quantities can be dispensed therewith. Quantities in the ml. range are once again difficult to dispense.

OBJECT

The object of the present invention is to provide a dosing device which allows a more precise dosing of a liquid or the like present in a container. At the same time, the dosing device should be simple to clean and thus capable of repeated use. In addition, the dosing device should be usable for different container sizes and easy to fit and to operate.

ACHIEVEMENT OF THE OBJECT

Leading to the achievement of the present object is the fact that the inlet and the discharge opening are disposed separate from each other, a dosing and displacement chamber being provided between them and the inlet and/or discharge opening being closable.

Such a configuration of the dosing device enables a desired quantity of liquid to be drawn firstly into the dosing and displacement chamber, before it is then dispensed. During the suction operation, the discharge opening is closed, to prevent the liquid from flowing off. During the dispensing of the liquid, the inlet is then closed, to prevent further liquid from being inadvertently drawn into the dosing and displacement chamber and thus falsifying the result.

In order to allow a separate opening and closing of the inlet and of the discharge opening, the inlet is disposed in a housing with molded-on screw fastening and the discharge opening is disposed in an actuating element, the actuating element being inserted movably and rotatably in the housing. The inlet can be closed off with a ball valve, whereas the discharge opening is rotated by the rotation of the actuating element out of its connection with a duct for dispensing the liquid.

According to the present illustrative embodiments, the actuating element can be differently designed.

Thus, in a first illustrative embodiment, the actuating element is inserted in a plunger having a molded-on nozzle. The nozzle is provided with the duct, which, upon appropriate rotation of the actuating element, enters into connection with the discharge opening. On the other hand, the discharge opening is connected to a riser in the actuating element. This riser, in turn, opens out in the downward direction into the dosing and displacement chamber of the housing.

In a second illustrative embodiment, the actuating element is inserted directly in the housing. A nozzle is inserted rotatably in the actuating element and has the discharge opening. According to the rotation of the nozzle, this discharge opening can be brought into connection with the riser of the actuating element or rotated out of the connection.

A further option for the design of the actuating element is shown in the third illustrative embodiment. Here, the discharge opening is located in a turning lever, which, in turn, is disposed rotatably in the actuating element and crosses the riser of the actuating element. Through the rotation of the turning lever, the discharge opening can be rotated into the riser, so that liquid can be dispensed from the riser, through the discharge opening, into, for example, a measuring beaker or the like.

A further option for the design of the actuating button is shown by a fourth illustrative embodiment. Upon use of the dosing device, a cap is slipped onto a molded-on arm of the actuating element. This cap likewise has a discharge opening, which, upon appropriate rotation of the cap, enters into connection with the riser of the actuating element.

The scope of design of the actuating element and of the nozzle, the turning lever or the cap is very varied. Consequently, the present invention is not intended to be limited to the four illustrative embodiments shown. It is wholly conceivable to combine the options shown, to adopt individual elements or to omit others.

The different options for the shape and design of the actuating element and of the nozzle, with or without plunger, of the turning lever or of the cap are intended to be covered by the present invention. In this context, it is important merely that the discharge opening can be brought into connection and out of connection with a final outlet opening.

The different fastening options for the elements which are not molded onto the actuating element from the front, such as the turning lever or the cap, are also intended to be covered by the present invention. In the corresponding illustrative embodiments, rings were preferred which, following the insertion of the respective element, i.e. of the turning lever or of the cap, engaged in corresponding annular grooves of the actuating element. Other latching elements are conceivable.

Serving as a seal for the individual elements one against the other, and between media to be dispensed and the outside air, are, for example, sealing cams or an annular rib on the bottom side of the actuating element, which, in a depressed state of the actuating element, enter into engagement with correspondingly shaped recesses in the screw fastening.

In addition, the actuating element, in its extension inserted in the dosing and displacement chamber of the housing, is provided with a sealing ring, which prevents liquid from being able to make its way outward out of the dosing and displacement chamber.

In the screw fastening, furthermore, a further sealing element is provided, which serves to seal the liquid.

In the illustrative embodiment in which the actuating element is firstly inserted in a plunger, a sealing cam, which enters into a sealing groove, is provided between the actuating element and the plunger in order to seal the two elements one against the other. Furthermore, the actuating element is provided with a sealing and snap lip, which, in the usage position, bears against the underneath of a plunger lip of the plunger and simultaneously serves as a seal.

The different options for the shape and design of the seals of the individual elements one against the other, and between media to be dispensed and the outside air, are intended to be covered by the present invention.

In addition, indicators are provided on the nozzle, which are intended to indicate to a user the instantaneous position of the discharge opening in the actuating element. The indicators can be represented in any chosen manner. In the present illustrative embodiments, the form of characters has been chosen. Thus, for example, on the nozzle, the turning lever and/or the cap or the like, a "CLOSED" or an "OPEN" symbol can be read, according to the position of the discharge opening.

If the nozzle is fixed, as is the case in the illustrative embodiment comprising the plunger, then the "CLOSED" and "OPEN" symbols are provided on the plunger. The actuating element, on the other hand, exhibits an arrow, which, according to the position of the discharge opening or the rotation of the actuating element, points to the respective symbol.

The options for identifying the position of the discharge opening are manifold. Thus, in place of characters, symbols, markings or the like can also perfectly well be used. In this context, no limits should be placed upon the invention.

The different options for the design of the housing and of the screw fastening are also intended to be covered by the present invention. For better guidance of the plunger or of the actuating element, the housing is provided with additional guide elements, which simultaneously, in conjunction with a scale on an outer side of the plunger or of the actuating element, serve as a snap-locking element or catch mechanism for the stroke control. Further guide ribs can be disposed on a top side of the screw fastening. They give the user additional guidance on the position for the dispensing of liquid. Other options for the guidance of the plunger or of the rotation element are conceivable.

In addition, the screw fastening, as well as the actuating element, can be provided with a knurl, which knurl allows better handling of the screw fastening or actuating element respectively.

Furthermore, the housing, in the inlet region, is allotted holding ribs, between which the ball valve is squeezed in. The holding ribs are intended, as liquid is drawn in, to prevent the ball valve from floating upward with the liquid and thus blocking the opening for the riser in the actuating element. Preferably, four holding ribs are provided. It is also conceivable, however, to provide fewer or more holding ribs, or even a circumferential ring collar. Here too, no limits are intended to be placed upon the invention.

DESCRIPTION OF THE FIGURES

Further advantages, features and details of the invention emerge from the following description of preferred illustrative embodiments and with reference to the drawing, in which.

Figure 1:
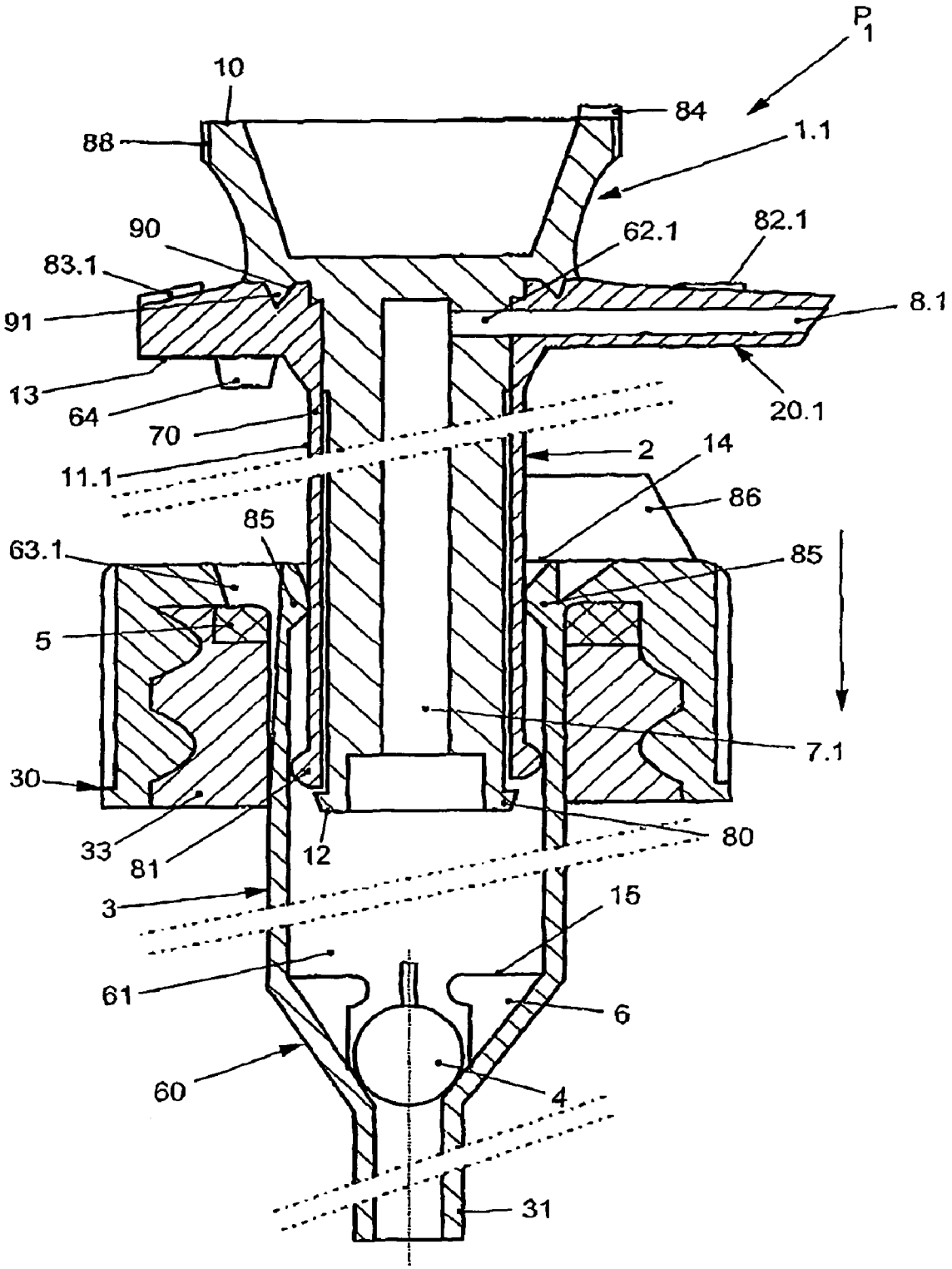
FIG. 1 shows a longitudinal section through a dosing device according to an illustrative embodiment of the present invention.

According to FIG. 1, a dosing device $P_1$ has an actuating element 1.1 in a plunger 2 having a molded-on nozzle 20.1, which together are inserted in a housing 3 having a molded-on screw fastening 30.

The actuating element 1.1 is configured extended in the downward direction and is inserted in the plunger 2, it being loosely snap-fastened to the latter to allow a rotational motion of the actuating element 1.1. A sealing groove 90 here serves, in cooperation with a sealing cam 91 between the actuating element 1.1 and the plunger 2, to seal off the device against the atmosphere.

In order to prevent the actuating element 1.1 from slipping out of the plunger 2, the actuating element 1.1 is provided with a sealing and snap lip 80, which, in the usage position, bears against the underneath of a plunger lip 81 of the plunger 2 and simultaneously serves as a seal.

The actuating element 1.1 further has inside it a riser 7.1, which is connected by a discharge opening 62.1 to an outlet duct 8.1 in the nozzle 20.1. In the downward direction, the riser 7.1 opens out into a dosing and displacement chamber 61 of the housing 3.

On the upper rim 10 of the actuating element 1.1 an arrow 84 is provided, with which an "OPEN" setting or a "CLOSED" setting of the actuating element 1.1 can be indicated. The arrow 84 shows the user the application and gives the system the functional orientation.

A knurl 88 and an overall concave shaping simplify handling of the actuating element 1.1.

The plunger 2 has on its outer side 11.1 a scale 70. This serves as a "ml" indicator and shows the user the desired dose quantity.

The plunger 2 is additionally provided with an indicator 83.1 for the "CLOSED" setting and the nozzle 20.1 has an indicator 82.1 for the "OPEN" setting. Both indicators 82.1 and 83.1 cooperate with the arrow 84 on the actuating element 1.1 when the dosing device $P_1$ is in use.

On an underside 13 of the plunger 2 sealing cams 64 are provided, which, whenever the actuating element 1.1, and hence the plunger 2, is pressed down, enter into engagement with a correspondingly shaped recess 63.1 in the screw fastening 30. The recess 63.1 is connected to the interior of the container and ensures an air equalization.

The housing 3 encloses the dosing and displacement chamber 61 and tapers down into a suction tube 31. It is embraced by the screw fastening 30. For better guidance of the plunger motion, the housing 3 is provided with additional guide elements 85, which, in conjunction with the scale 70, simultaneously serve as a snap-locking element or catch mechanism for the stroke control. Further guide ribs 86 are disposed on a top side 14 of the screw fastening 30. They give the user additional guidance on the position for the dispensing of liquid.

A sealing element 5 serves the further liquid-sealing of the device $P_1$. The sealing element 5 is disposed in the screw fastening 30.

An inlet 60 is provided in the lower region of the dosing and displacement chamber 61 and forms a transition between the dosing and displacement chamber 61 and the suction tube 31. The inlet 60 is conically configured and preferably has inside it four retaining ribs 6. Squeezed in between these retaining ribs 6 there is a ball valve 4, which seals the inlet 60 in the downward direction.

Figure 4:
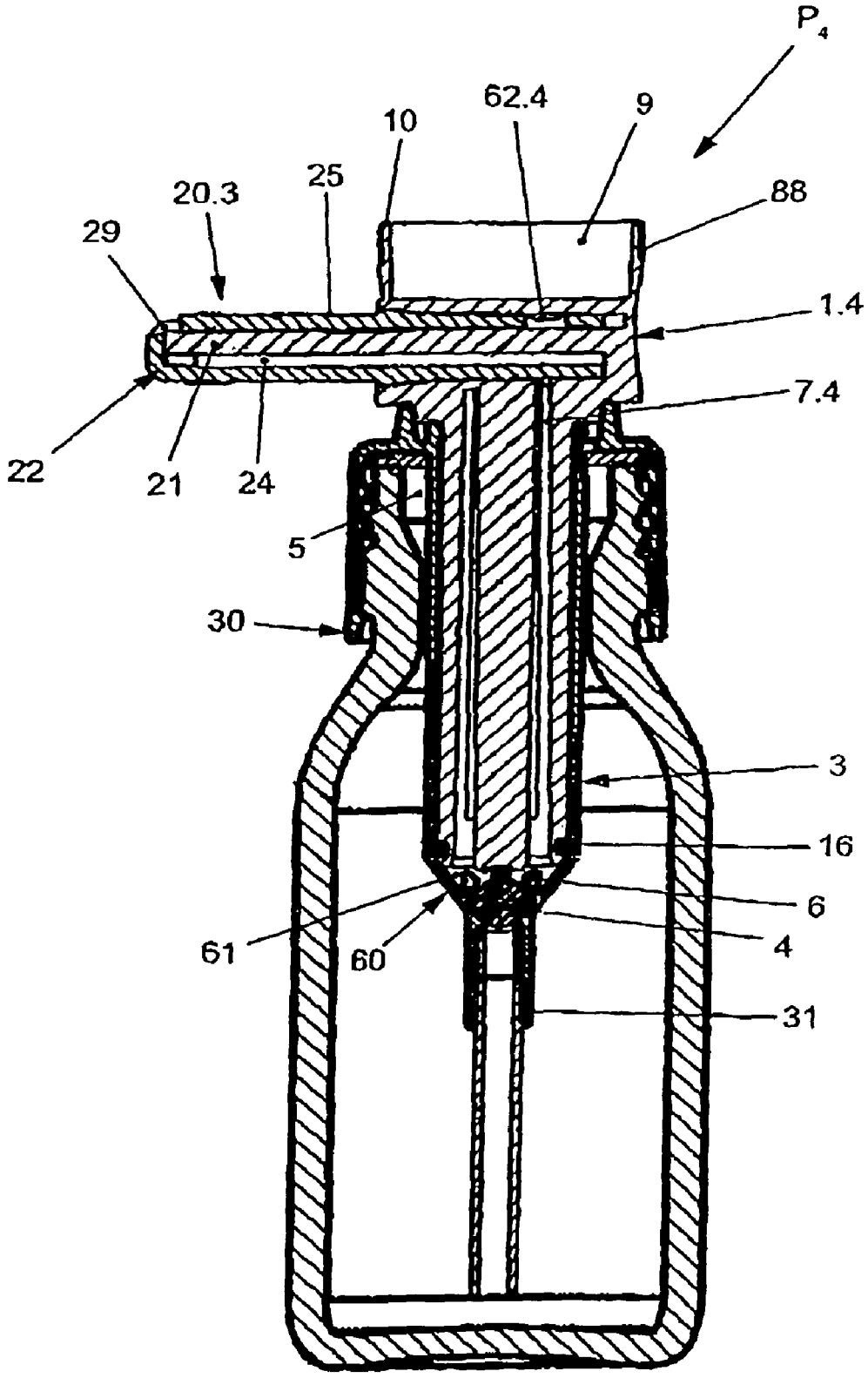
FIG. 4 shows a longitudinal section through a dosing device according to a further illustrative embodiment of the present invention in a bottle.

The mode of operation of the present invention is as follows:

Firstly, the dosing device $P_1$ is screwed by means of the screw fastening 30 onto a container, for example a glass or plastic bottle, not represented in greater detail in FIG. 4, of which only a part of a neck 33 is shown here. The suction tube 31 is cut appropriately to length according to the length of the container.

In the starting position of the device $P_1$, the actuating element 1.1, together with the plunger 2, is in a depressed position, so that the sealing cams 64 of the plunger 2 are located in the recess 63.1 of the screw fastening 30. A bottom side 12 of the actuating element 1.1 in this case comes to lie upon a top side 15 of the retaining ribs 6 in the dosing and displacement chamber 61 of the housing 3. The actuating element 1.1 is turned, so that the arrow 84 points in the direction of the indicator 83.1 for the "CLOSED" setting.

Through pulling on the actuating element 1.1, the sealing and snap lip 80, together with the plunger lip 81, prevents an intake of air from outside. The generated underpressure draws liquid or the like out of the container via the suction tube 31 through the inlet 60 into the dosing and displacement chamber 61, by the ball valve 4 being lifted out of its sealing fit. At the same time, after the sealing cam 64 has been lifted off, air is drawn in through the recess 63.1 into the container, so that an equalization takes place. The desired dosage can be read off from the scale 70, which juts out over the top side 14 of the screw fastening 30.

In order to dispense the drawn-in liquid, the actuating element 1.1 is rotated until the arrow 84 is pointing at the indicator 82.1 for the "Open" setting.

Next, the actuating element 1.1, together with the plunger 2, is pressed downward again. As the actuating element 1.1. is pressed down, the sealing cam 91 in the sealing groove 90 seals off to the atmosphere, so that the liquid or the like can only take the path through the riser 7.1 and makes its way through the discharge opening 62.1 into the outlet duct 8.1 of the nozzle 20.1.

Once the stroke is completed, i.e. the actuating element 1.1 and the plunger 2 have again reached the top side 15 of the retaining ribs 6, the actuating element 1.1 must be brought by rotation back into the rest position or bearing position. The sealing cam 64 now finds itself back in the recess 63.1 of the screw fastening 30, and the discharge opening 62.1, as the connection between the outlet duct 8.1 of the nozzle 20.1 and the riser 7.1, is cut off.

When the actuating element 1.1 is rotated, the sealing and snap lip 80 and the sealing groove 90 serve to seal off the device $P_1$ against the atmosphere.

The handling of the device $P_1$, i.e. pulling on the actuating element 1.1 until the desired volume is reached, rotation of the actuating element 1.1 so as to bring the discharge opening 62.1 into connection with the outlet duct 8.1, pressing down of the actuating element 1.1 to the stop on the retaining ribs 6 so as to deliver the product, rotation of the actuating element 1.1 so as to lock the device $P_1$ in the rest position, constitutes a child-locking protection, since different motional sequences are connected in series.

Figure 2:
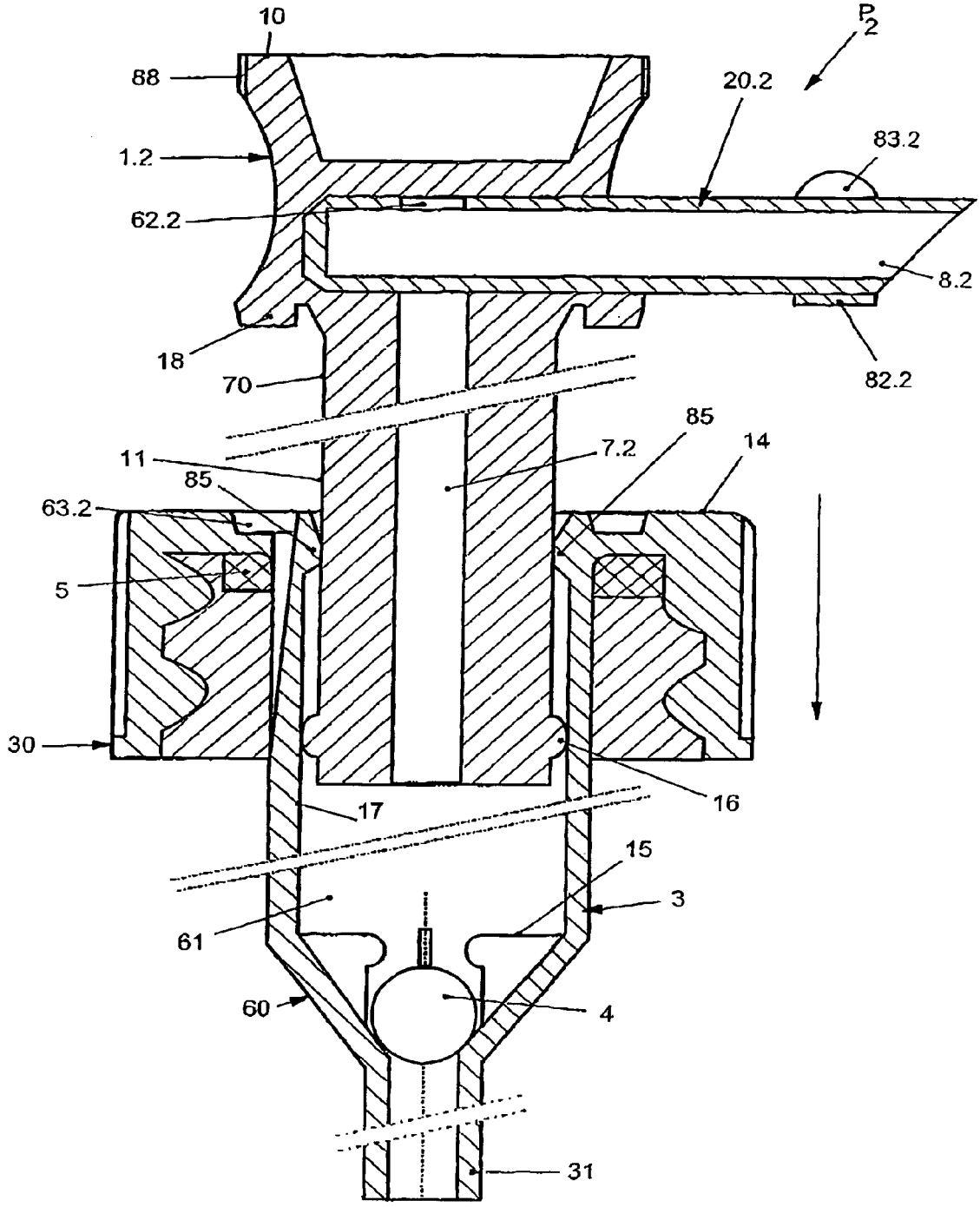
FIG. 2 shows a longitudinal section through a dosing device according to a further illustrative embodiment of the present invention.

In a second illustrative embodiment of the present invention according to FIG. 2, the device $P_2$ roughly corresponds to the device $P_1$. Only the actuating element 1.2 is configured differently. Thus, the actuating element 1.2 is not inserted in a plunger, but directly in the dosing and displacement chamber 61 of the housing 3. A sealing ring 16 seals the actuating element 1.2 with respect to a wall 17 of the dosing and displacement chamber 61, so that no liquid or the like can escape.

If the actuating element 1.2 is pressed downward, an annular rib 18 on the actuating element 1.2 enters into the correspondingly shaped recess 63.2 of the screw fastening 30 and seals off the device $P_2$ in the outward direction.

A further difference lies in the design of the nozzle 20.2. This is not, as previously described, molded onto a plunger. Instead, the nozzle 20.2 is disposed rotatably in the actuating element 1.2. A discharge opening 62.2 serves in an "OPEN" setting of the nozzle 20.2 as a connection between a riser 7.2 of the actuating element 1.2 and the outlet duct 8.2 of the nozzle 20.2. In the "CLOSED" setting of the nozzle 20.2, the discharge opening 62.2 is turned away from the riser 7.2.

The indication of the respective settings of the nozzle 20.2 is served, once again, by two indicators 82.2 and 83.2, in a view from above the indicator 82.2 indicating the "OPEN" setting and the indicator 83.2 indicating the "CLOSED" setting.

The mode of operation of the present illustrative embodiment differs from the mode of operation of the previously described illustrative embodiment by the fact that the nozzle 20.2 for dispensing the liquid or the like has now to be rotated out of a "CLOSED" setting into an "OPEN" setting. The respective setting of the nozzle 20.2 can be easily read off from the respective indicators 82.2 or 83.2.

Through the rotation of the nozzle 20.2, the discharge opening 62.2 enters into flow connection with the riser 7.2 of the actuating element 1.2, so that a pressing of the actuating element 1.2 allows the liquid or the like drawn into the dosing and displacement chamber 61 to be pumped through the riser 7.2 and the discharge opening 62.2 into the outlet duct 8.2 of the nozzle 20.2, and from there to the outside.

Following the process, the nozzle 20.2 is rotated back into its "CLOSED" setting, so that no liquid or the like can any longer make its way outward.

Figure 3:
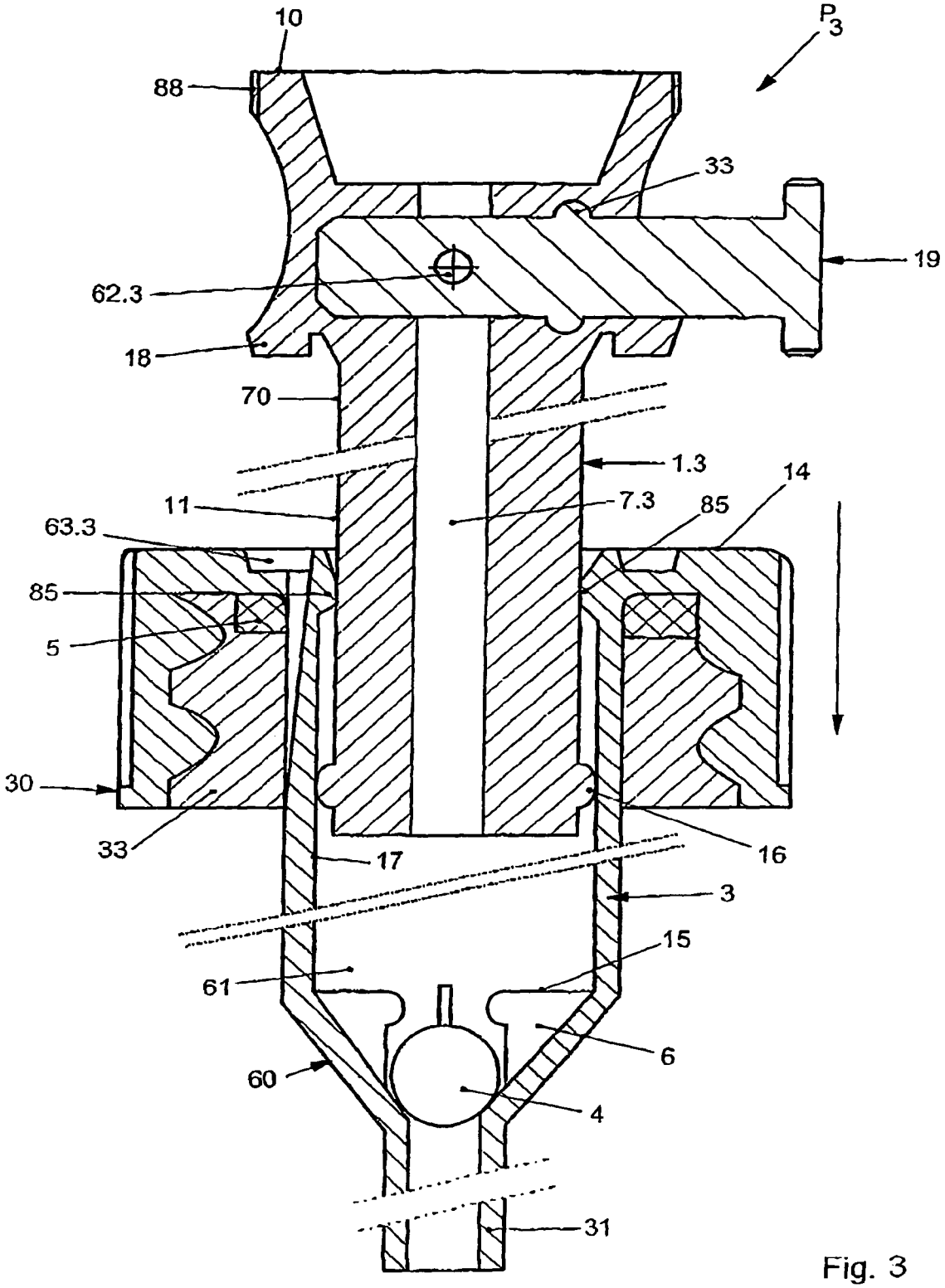
FIG. 3 shows a longitudinal section through a dosing device according to a further illustrative embodiment of the present invention.

In a further illustrative embodiment according to FIG. 3, the actuating element 1.3 is once again configured differently. Thus, instead of a nozzle, a turning lever 19 is in this case provided, which crosses the riser 7.3 of the actuating element 1.3 and has a discharge opening 62.3 in the form of a transverse bore.

The mode of operation of the present illustrative embodiment is similar to that previously stated. Through the rotation of the turning lever 19 from a "CLOSED" setting into an "OPEN" setting, the discharge opening 62.3 makes its way into a flow-passage setting with the riser 7.3 of the actuating element 1.3, which riser opens out into a product receptacle 9.

In this way, liquid or the like which was previously drawn into the dosing and displacement chamber 61 can be pumped through the riser 7.3 and the discharge opening 62.3 into the product receptacle 9 as the actuating element 1.3 is pressed down.

Figure 5:
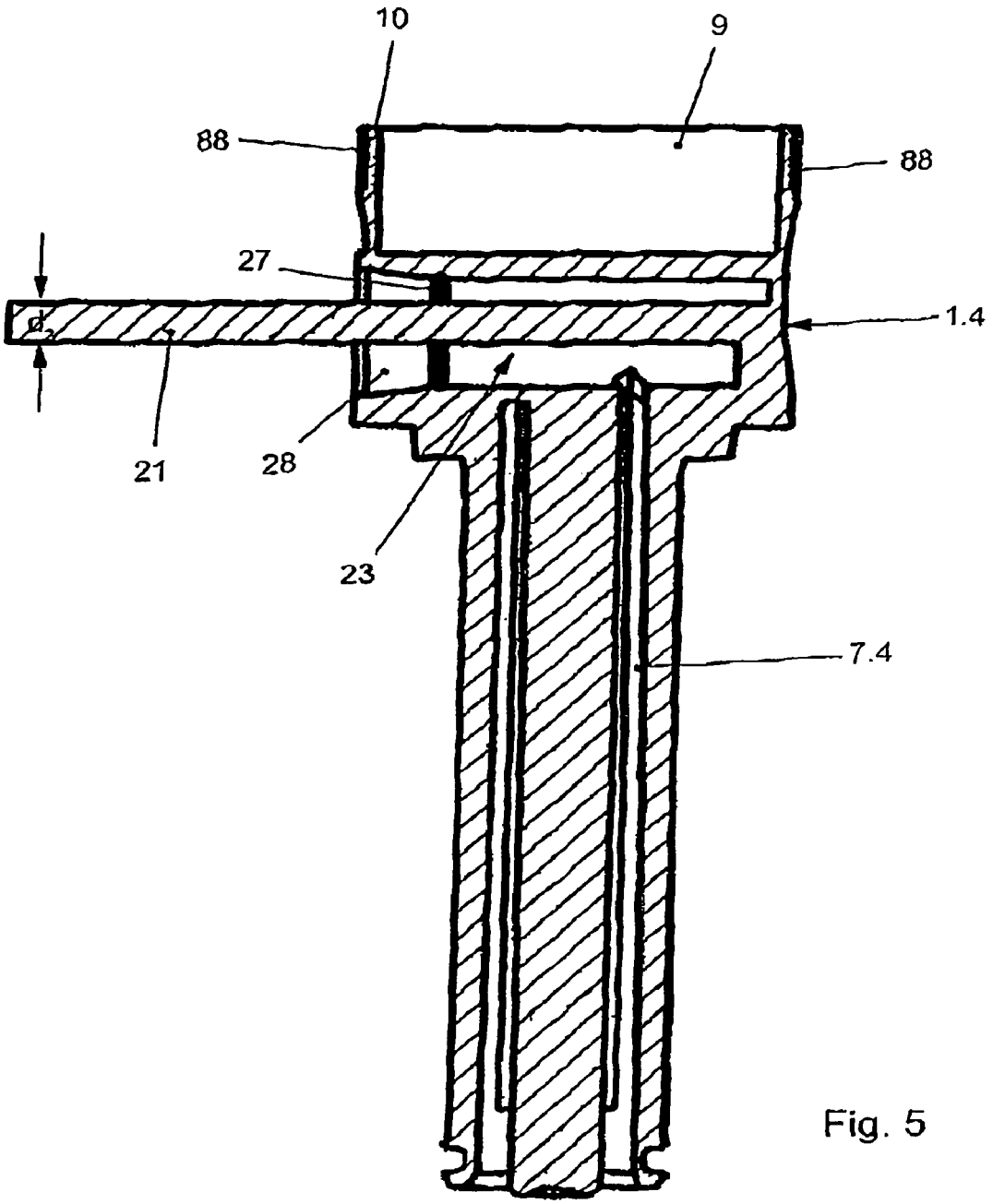
FIG. 5 shows a view of an actuating element of the dosing device in FIG. 4.
Figure 6A:
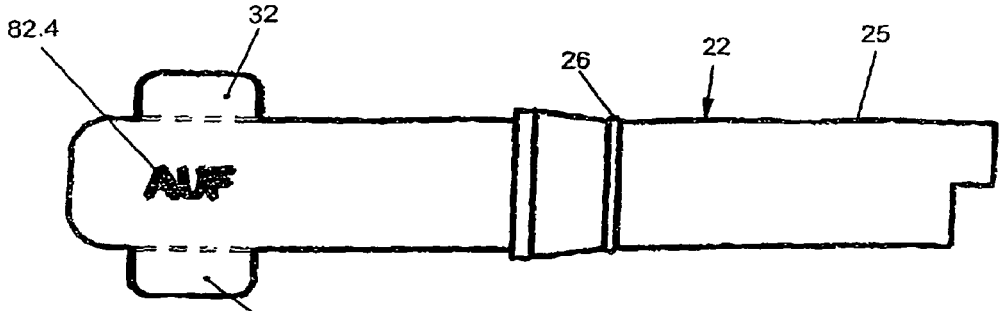
FIG. 6*a* shows a top view of a cap of the dosing device in FIG. 4 in "Open" setting.
Figure 6B:
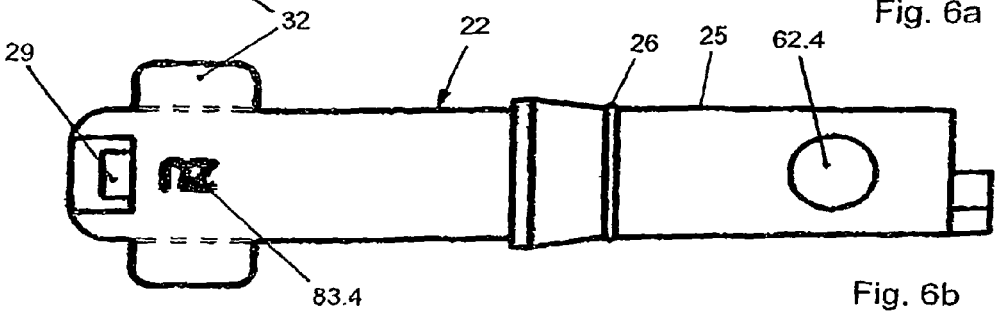
FIG. 6*b* shows a top view of the cap in FIG. 6*a* in "Closed" setting.
Figure 6C:
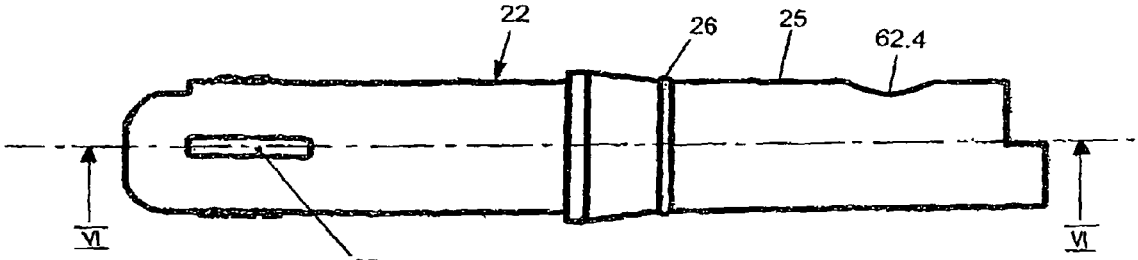
FIG. 6*c* shows a side view of the cap in FIG. 6*a*.
Figure 6D:
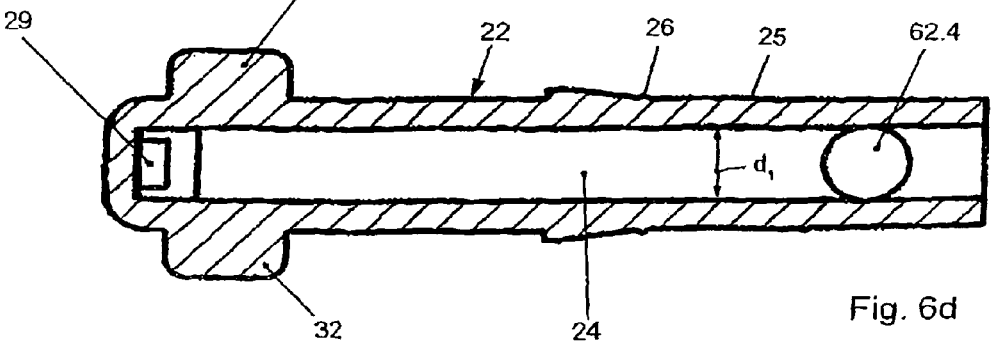
FIG. 6*d* shows a longitudinal section through the cap along the line VI-VI in FIG. 6*c*.

In a further illustrative embodiment of the invention according to FIGS. 4 to 6, the actuating element 1.4 is configured such that an arm 21 protrudes from the actuating element 1.4, onto which a cap 22, represented in FIGS. 6*a* to 6*d*, is slipped. Together they form a nozzle 20.3.

As can be seen from FIG. 5, the arm 21 is connected in one piece to the actuating element 1.4 and guided in a duct 23. The duct 23 is connected, in turn, to a part of a riser 7.4, which, in the present illustrative embodiment, is of annular configuration.

The cap 22 forms with the arm 21 a duct 24, since the internal diameter $d_1$ of the cap 22 is greater than a diameter $d_2$ of the arm 21 which enters into it. Thus, alongside the arm 21, there remains sufficient space for the liquid or the like guided in the duct 24.

The cap 22 further has on its outer face 25 a ring 26. After the cap 22 has been slid into the duct 23 of the actuating element 1.4, this ring 26 engages with a correspondingly shaped annular groove 27 in a wall 28 of the duct 23 and prevents the cap 22 from slipping out of the duct 23.

In addition, a discharge opening 62.4 is provided in the cap 22, which, when the cap 22 is rotated into the "OPEN" setting, enters into correspondence with the riser 7.4 of the actuating element 1.4. Consequently, through pressing down of the actuating element 1.4, liquid or the like which has previously been drawn into the dosing and displacement chamber 61 can be pumped through the riser 7.4 and the discharge opening 62.4 into the duct 24 of the cap 22, and makes its way out from there via an outlet opening 29.

Wing-like elements 32 on the outer face 25 of the cap 22 facilitate a rotation of the cap 22 from the "CLOSED" setting into the "OPEN" setting, and vice versa.

ITEM NUMBER LIST

| | |
|---|---|
| 1 | actuating element |
| 2 | plunger |
| 3 | housing |
| 4 | ball valve |
| 5 | sealing element |
| 6 | retaining ribs |
| 7 | riser |
| 8 | outlet duct |
| 9 | product receptacle |
| 10 | rim |
| 11 | outer side |
| 12 | bottom side |
| 13 | Underside |
| 14 | top side |
| 15 | top side |
| 16 | sealing ring |
| 17 | Wall |
| 18 | annular rib |
| 19 | turning lever |
| 20 | Nozzle |
| 21 | Arm |
| 22 | Cap |
| 23 | Duct |
| 24 | Duct |
| 25 | outer face |
| 26 | Ring |
| 27 | annular groove |
| 28 | Wall |
| 29 | outlet opening |
| 30 | screw fastening |
| 31 | suction tube |
| 32 | wing element |
| 33 | Ring |
| 34 | Neck |
| 35 | |
| 36 | |
| 37 | |
| 38 | |
| 39 | |
| 40 | |
| 41 | |
| 42 | |
| 43 | |
| 44 | |
| 45 | |
| 46 | |
| 47 | |
| 48 | |
| 49 | |
| 50 | |
| 51 | |
| 52 | |
| 53 | |
| 54 | |
| 55 | |
| 56 | |
| 57 | |

-continued

| | |
|---|---|
| 58 | |
| 59 | |
| 60 | Inlet |
| 61 | dosing chamber |
| 62 | discharge opening |
| 63 | Recess |
| 64 | sealing cam |
| 65 | |
| 66 | |
| 67 | |
| 68 | |
| 69 | |
| 70 | scale |
| 71 | |
| 72 | |
| 73 | |
| 74 | |
| 75 | |
| 76 | |
| 77 | |
| 78 | |
| 79 | |
| 80 | sealing and snap lip |
| 81 | plunger lip |
| 82 | indicator |
| 83 | indicator |
| 84 | arrow |
| 85 | guide element |
| 86 | guide ribs |
| 87 | |
| 88 | knurl |
| 89 | |
| 90 | sealing groove |
| 91 | sealing cam |
| 92 | |
| 93 | |
| d1 | diameter |
| d2 | diameter |

The invention claimed is:

1. A dosing device for sucking in and expelling a flowable medium comprising a container having an inlet (60) and a duct (62.1 to 62.4), wherein the inlet (60) and the duct (62.1 to 62.4) are disposed separately from one another, a dosing and displacement chamber (61) is provided and inlet (60) and duct (62.1 to 62.4) are closable and the inlet (60) and the dosing and displacement chamber (61) are disposed in a housing (3), wherein the inlet (60) opens into the dosing chamber (61) and wherein attached to the housing (3) and the inlet (60) is a suction pipe (31), through which the flowable medium may be sucked into the dosing and displacement chamber (61), and wherein there is inserted into the housing (3) an actuating element (1.1 to 1.4), in which the duct (62.1 to 62.4) is provided, wherein an ascending tube (7.1 to 7.4) in the actuating element (1.1 to 1.4) interacts with the duct (62.1 to 62.4) and wherein on or in the actuating element (1.2 to 1.4) a spout (20.1, 20.2, 20.3) or a rotary lever (19) is rotatably disposed and the duct (62.1, 62.2, 62.3, 62.4) may be brought into connection with an outlet channel (8.1, 8.2, 24) in the spout (20.1, 20.2, 20.3), wherein the duct (62.1, 62.2, 62.3, 62.4) for sucking in the medium is closable by means of the spout (20.1, 20.2, 20.3) and/or the rotary lever (19) but during expelling of the medium is openable by rotating the spout (20.1, 20.2, 20.3) and/or the rotary lever (19), and wherein by rotating the actuating element (1.1) the duct (62.1) is rotatable out of its connection to the outlet channel (8.1) of the spout (20.1), wherein the outlet channel (8.1) is closed by means of the piston (2).

2. A dosing device according to claim 1, wherein the inlet (60) is closable by means of a valve ball (4) that is pressed in between retaining ribs (6).

3. A dosing device according to claim 1, wherein disposed on the housing (3) is a screw-type cap (30), wherein in the screw-type cap (30) an opening (63.1, 63.2) is provided for air equalization, and wherein in the screw-type cap (30) a sealing element (5) is disposed.

4. A dosing device according to claim 3, wherein the screw-type cap (30) has guide ribs (86) for guiding a piston (2), which is inserted into the housing (3) and into which the actuating element (1.1) is inserted.

5. A dosing device according to claim 4, wherein on the housing (3) at least one guide element (85) is provided for guiding the movement of the piston (2) and/or of the actuating element (1.2 to 1.4).

6. A dosing device according to claim 5, wherein on an outer side (11) of the piston (2) and/or of the actuating element (1.2 to 1.4) a scale (70) is provided for indicating a dosing quantity.

7. A dosing device according to claim 4, wherein on the piston (2) a piston lip (81) and on the actuating element (1.1) a sealing and snap action lip (80) are provided for preventing the entry of air and between the actuating element (1.1) and the piston (2) a sealing groove (90) is provided for sealing purposes.

8. A dosing device according to claim 4, wherein on an underside (13) of the piston (2) at least one sealing cam (64) is provided and may be brought into engagement with the opening (63.1) in the screw-type cap (30).

9. A dosing device according to claim 4, wherein the piston (2) is provided with the indicators (82.1, 83.1) for a "CLOSED" position and an "OPEN" position.

10. A dosing device according to claim 1, wherein the actuating element (1.1 to 1.4) has a product-receiving recess (9).

* * * * *